US007062811B2

(12) United States Patent
Fuessinger et al.

(10) Patent No.: US 7,062,811 B2
(45) Date of Patent: Jun. 20, 2006

(54) COLLAPSIBLE BRIDGE AND METHOD OF MAKING AND USING SAME

(75) Inventors: Reinhold Fuessinger, Friedrichshafen (DE); Walter Steppacher, Immenstaad (DE)

(73) Assignee: Eurobridge Mobile Bruecken GmbH, Friedrichshafen (DE)

( * ) Notice: Subject to any disclaimer, the term of this patent is extended or adjusted under 35 U.S.C. 154(b) by 9 days.

(21) Appl. No.: 10/661,769

(22) Filed: Sep. 15, 2003

(65) Prior Publication Data

US 2004/0123406 A1 Jul. 1, 2004

(30) Foreign Application Priority Data

Sep. 14, 2002 (DE) ..... 102 42 860

(51) Int. Cl.
*E01D 15/12* (2006.01)

(52) U.S. Cl. ..... 14/2.4; 14/13

(58) Field of Classification Search ..... 14/2.4, 14/2.5, 18, 27, 77.1, 3, 4, 13, 74.5
See application file for complete search history.

(56) References Cited

U.S. PATENT DOCUMENTS

| | | | | |
|---|---|---|---|---|
| 3,504,389 | A * | 4/1970 | Longbottom | 14/13 |
| 3,685,074 | A * | 8/1972 | Marshall et al. | 14/27 |
| 3,886,613 | A * | 6/1975 | Busch et al. | 14/14 |
| 4,017,932 | A * | 4/1977 | Lotto et al. | 14/2.4 |
| 4,521,932 | A * | 6/1985 | Parramore | 14/2.5 |
| 5,724,691 | A | 3/1998 | Wiedeck et al. | 14/2.4 |
| 2001/0002497 | A1 * | 6/2001 | Scuero | 14/73 |

FOREIGN PATENT DOCUMENTS

| | | |
|---|---|---|
| CH | 666 500 A5 | 12/1982 |

(Continued)

OTHER PUBLICATIONS

European Search Report Nov. 16, 2004.

*Primary Examiner*—Thomas B. Will
*Assistant Examiner*—Alexandra Pechhold
(74) *Attorney, Agent, or Firm*—Crowell & Moring LLP

(57) ABSTRACT

A collapsible bridge has two track girders constructed as truss girders with a triangular cross-section. A chord profile is provided at each triangulation point and two corners of the triangular cross-section are situated at the same level with the third corner situated above the corner. A pair of truss planes are formed from diagonal struts, a lower chord and an upper chord, with lower and upper truss nodes respectively being formed at connection points of two diagonal struts and a lower chord and an upper chord respectively. The two track girders are force-lockingly connected by transverse girders. Roadway planks are provided which are aligned in the longitudinal direction of the bridge and are force-lockingly connected with the transverse girders. The transverse girders are fitted completely through the track girders and are force-lockingly connected with the latter, so that the transverse girders fix the distance between the two truss planes on the bottom side of a track girder as well as the two track girders with respect to one another. The transverse girders rest on lower nodes of the two truss planes of a track girder and are force-lockingly connected therewith. The two truss planes of a track girder are connected at the upper triangulation point of the track girder cross-section by a hinge, such that, when the bridge is taken down, the track girders can be folded together.

21 Claims, 3 Drawing Sheets

FOREIGN PATENT DOCUMENTS

| | | |
|---|---|---|
| CH | 666500 A5 * | 7/1988 |
| DE | 2 250 013 | 4/1973 |
| DE | 195 10 582 A I | 3/1995 |
| DE | 195 10 582 | 10/1996 |
| EP | 0 600 321 A 1 | 11/1993 |
| GB | 1 405 146 | 9/1975 |

* cited by examiner

CROSS BEAM
FASTENING

COLLAPSIBLE BRIDGE AND METHOD OF MAKING AND USING SAME

BACKGROUND AND SUMMARY OF THE INVENTION

This application claims the priority of application no. 102 42 860.3-25 filed in Germany on Sep. 14, 2002, the disclosure of which is expressly incorporated by reference herein.

The invention relates to a collapsible bridge; that is, a portable bridge for mobile use.

From German Patent Document DE 195 10 582 A1 (corresponding U.S. Pat. No. 5,724,691), a portable bridge is known whose track girders are force-lockingly connected by means of transverse girders. In this case, a transverse girder forms a part of the lower chord. Furthermore, roadway planks are provided which are aligned in the longitudinal direction of the bridge and are force-lockingly connected with the transverse girders. The track girders each comprise two truss planes of diagonal struts, the lower chord and the upper chord. These components forming the track girder are in each case mutually connected by means of connections which can be released again.

German Patent Document DE 2 250 013 A1 (corresponding GB Patent No. 1 405 146) describes a portable bridge whose track girders have a triangular cross-section. A chord profile exists at each triangulation point. The two base sides of the track girders each consist of a so-called quadrilateral beam. This is a frame-type carrying structure with additional diagonal struts. The track girders cannot be changed with respect to their geometry. The transverse girders connected with the track girders are spliced at the track girders.

Portable bridges should be transported in a cost-effective manner with expenditures which are as low as possible. For this purpose, two characteristics are particularly important:

1. A low requirement with respect to transport space, 2 a low weight.

This applies particularly when the bridges have to be transported as air freight over large distances.

In order to implement light-weight bridge structures, the dimensions, mainly the height of the bending members of the carrying construction, should be as high as possible, and the used materials should be as light, firm and rigid as possible.

In order to implement bridge structures having a transport space requirement which is as low as possible, the components should be as small as possible and mainly should be easily stackable.

A conflict exists here between these preferred design features which is to be solved by means of the present invention.

It is therefore an object of the invention to provide a bridge which provide at least one or more of the following advantages:

- the bearing bending members can be selected to be as high as possible;
- the use of light-weight, firm and rigid materials, particularly fiber materials, can take place in an effective manner;
- the bridge can be transported with a space requirement which is as low as possible; and
- the bridge can rapidly be built up and taken down.

This object is achieved according to certain preferred embodiments of the invention by providing a collapsible bridge having two track girders which are constructed as truss girders with a triangular cross-section, wherein a chord profile is provided at each triangulation point, and wherein two corners of the triangular cross-section are situated at the same level, and the third corner is situated above the latter, wherein, in each case, between one of the lower triangulation points and the upper triangulation point, a truss plane is formed comprising diagonal struts, the lower chord and the upper chord, wherein lower and upper truss nodes respectively are formed at the points of the connection of two diagonal struts and a lower chord and an upper chord respectively.

The bridge according to certain preferred embodiments of the invention is constructed as follows:

- It comprises two track girders which are constructed as truss carries with a triangular cross-section, two corners of the triangular cross-section being situated at the same level, and the third corner being above the latter, in which case a truss plane comprising diagonal struts, a lower and an upper chord is formed in each case between one of the lower triangulation points and the upper triangulation point of the track girder cross-section, lower and upper truss nodes respectively being formed at the points of the connection of two diagonal struts and a lower chord and an upper chord respectively;
- the two track girders are force-lockingly connected by transverse girders;
- roadway planks aligned in the longitudinal direction of the bridge are provided which are force-lockingly connected with the transverse girders;
- the transverse girders are fitted completely through the track girders and are force-lockingly connected with the latter, so that the transverse girders fix the spacing of the two truss planes on the underside of the track girder as well as the track girders with respect to one another. In this case, the transverse girders rest on the lower nodes of the two truss planes of a track girder and are force-lockingly connected with the latter; and
- at the upper point of triangulation of the track girder cross-section, the two truss planes of a track girder are connected by means of a hinge, so that the track girders can be folded together when the bridge is taken down.

A bridge constructed in this manner has the following advantages:

- Because the bridge is subdivided into individual flat and easily stackable elements, it requires little transport space.
- Because the bridge is subdivided into individual predominantly one- or two-dimensionally stressed elements, the prerequisites are provided for the use of fiber composites, and low weights can therefore be achieved.

The described construction of the track girders provides the prerequisite for a simple collapsing of the track girders. The volume of the track girders is considerably reduced by the folding-together of the two truss planes for the transport. The static connection of each of the two truss planes is not disconnected during the collapsing. The static connection of the two truss planes is optimally implemented with respect to weight by means of unreleasable connections. Thus, there are no loose connection elements which could easily be lost in the terrain during rain, ice and snow and in darkness. The setting-up of the unfolded form of the track girder required for the use from the volume-saving folded-together form can be achieved with a minimal expenditure of time without any supplementary devices.

The transverse girders and the roadway planks are no primary structures; that is, their failure does not necessarily cause the failure of the bridge as a whole.

The transverse girders, roadway planks and collision aids can also be exchanged when the bridge is already constructed.

As a result of its low weight, the bridge requires correspondingly little counterweight when it is laid.

Advantageously, the track girders are coupled together of one or more track girder sections in the longitudinal direction of the bridge. At their ends, the track girders are closed off by means of end pieces. These may simultaneously be used as bridge bearings.

Typical spans of the bridge according to the invention are in the range of up to approximately 30 m.

Other objects, advantages and novel features of the present invention will become apparent from the following detailed description of the invention when considered in conjunction with the accompanying drawings.

DETAILED DESCRIPTION OF THE DRAWINGS

Figures 1, 1A, 1B, 2:
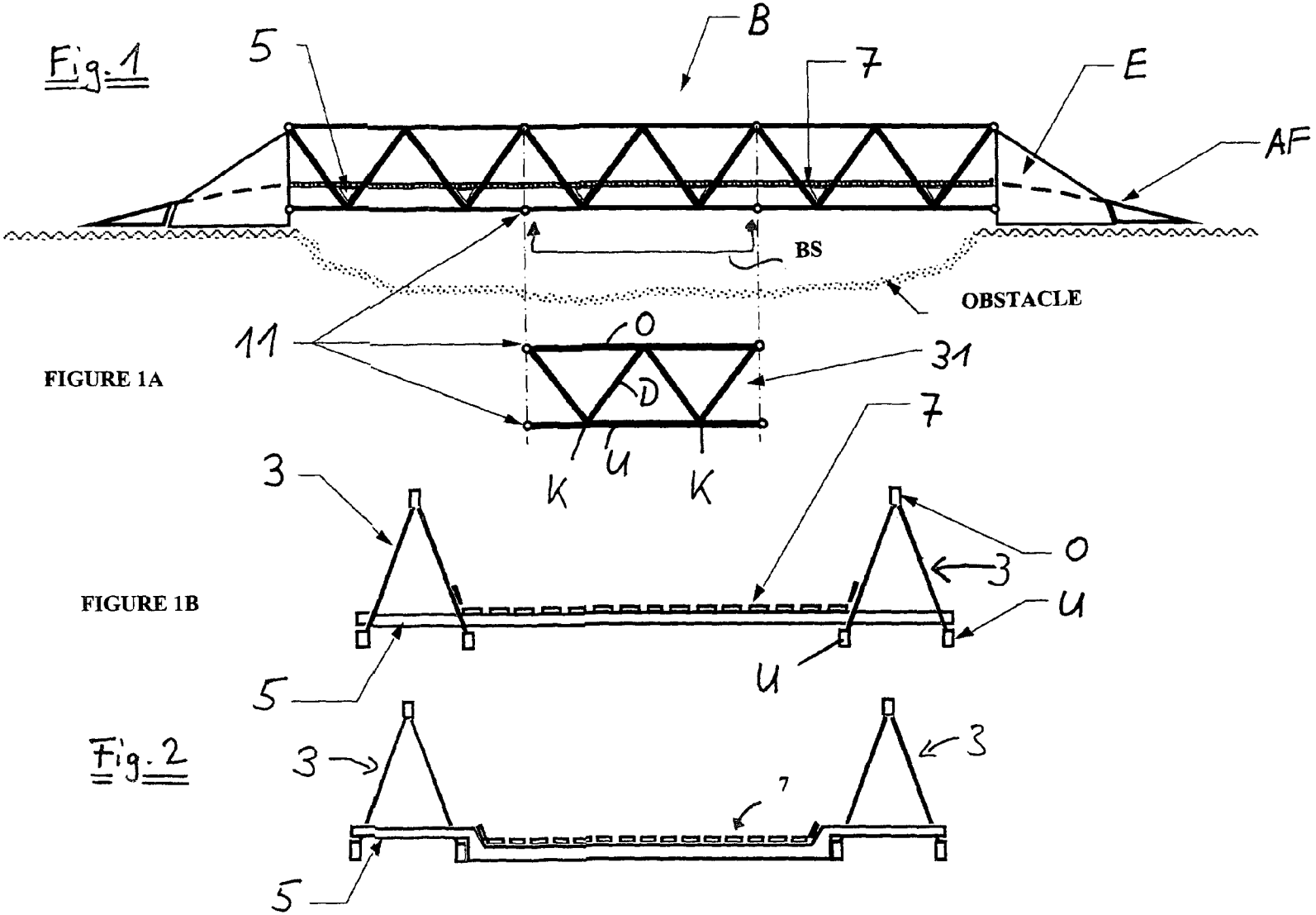
FIG. 1 is a lateral view of a bridge constructed according to a preferred embodiment of the invention comprising several bridge sections.
FIG. 1A is a sectional view transversely to the longitudinal direction of the bridge showing the bridge Section BS of FIG. 1.
FIG. 1B is a sectional view the bridge of FIGS. 1 and 1A with a substantially flat transverse girder.
FIG. 2 is a sectional view similar to FIG. 1B, showing a second embodiment with a transverse girder.

FIGS. 1, 1A, and 1B show an embodiment of a bridge B according to the invention in several views. Bridge B comprises two track girders 3 which are constructed as truss girders with a triangular cross-section. In this embodiment, the track girders 3 are coupled together from three tack girder sections 31 along the longitudinal direction of the bridge and are closed off by means of end pieces E at their ends. The end pieces E are coupled to the outer bridge section and form defined bearings of the bridge.

Drive-up aids or ramps AF, which bridge the height difference between the river bank and the upper edge of the bridge roadway, are arranged between the end pieces E of the track girders 3.

At each triangulation point in the cross-section of the track girders 3, chord profiles O, U are arranged, the two lower chord profiles U situated at the same level forming lower chords, and the chord profile O situated at the upper triangulation point forming the upper chord.

The coupling-together of the individual track girder sections 31 advantageously takes place at the upper chord O and the two lower chords U which, for this purpose may be constructed at their ends as eye bar connections. The coupling points between the individual track girder sections 31 have the reference number 11.

A track girder 3 has two truss planes which are each mounted between the upper triangulation point and one of the two lower triangulation points. The track girder 3 is open toward the bottom. However, for a further stiffening, additional demountable diagonal rods may be inserted as a wind brace between the two lower chords.

The points at which the diagonal struts D of the truss meet the lower or upper chord, U, O are called truss nodes K.

The truss corresponds to the truss definition according to Cremona. The latter is defined by the condition $s=2*n-3$, wherein s=the number of rods and n=the number of nodes. Such a truss can be designed to be optimal with respect to an advantageous weight and its resistance to bending.

The track girders 3 are connected by transverse girders 5. The transverse girders 5 rest on the lower nodes K of the two truss planes of the track girders 3 and are connected with the latter in a force-locking manner. The transverse girders 5 are fitted completely through the track girders 3, so that they fix the distance between the two truss planes on the underside of the track girder 3 and the two track girders 3 with respect to one another.

The transverse girders 5 rest on the base side of the triangle which is formed by the diagonal struts D and the chord profiles O, U. As a result, the forces which the transverse girder 5 diverts into the track girders 3 are directly and form-lockingly introduced into the diagonals D without stressing the lower chord U by forces transversely to its main stressing direction. The fastening of the transverse girder 5 at the track girders 3 is used only for the fixing of the unfolded truss planes and of the track girders with respect to one another, but not for transmitting the traffic loads to be diverted into the track girders by the transverse girders.

In the embodiment according to FIG. 2, the transverse girders 5 are bent at right angles in the area of the transition from the roadway into the track girders 3 so that the transverse girders are situated lower in the roadway area than inside a track girder.

Aligned in the span direction of the bridge, so-called roadway planks 7, which carry the traffic loads and place them on the transverse girders, are situated on the transverse girders 5. The roadway planks 7 represent the roadway of the bridge. They are force-lockingly connected with the transverse girders 5.

The transverse girder 5 and the roadway planks 7 may advantageously consist of tube-shaped fiber composite profiles which can be produced in a cost-effective manner, for example, by extruding.

Figures 3A, 3B, 3C, 3D:
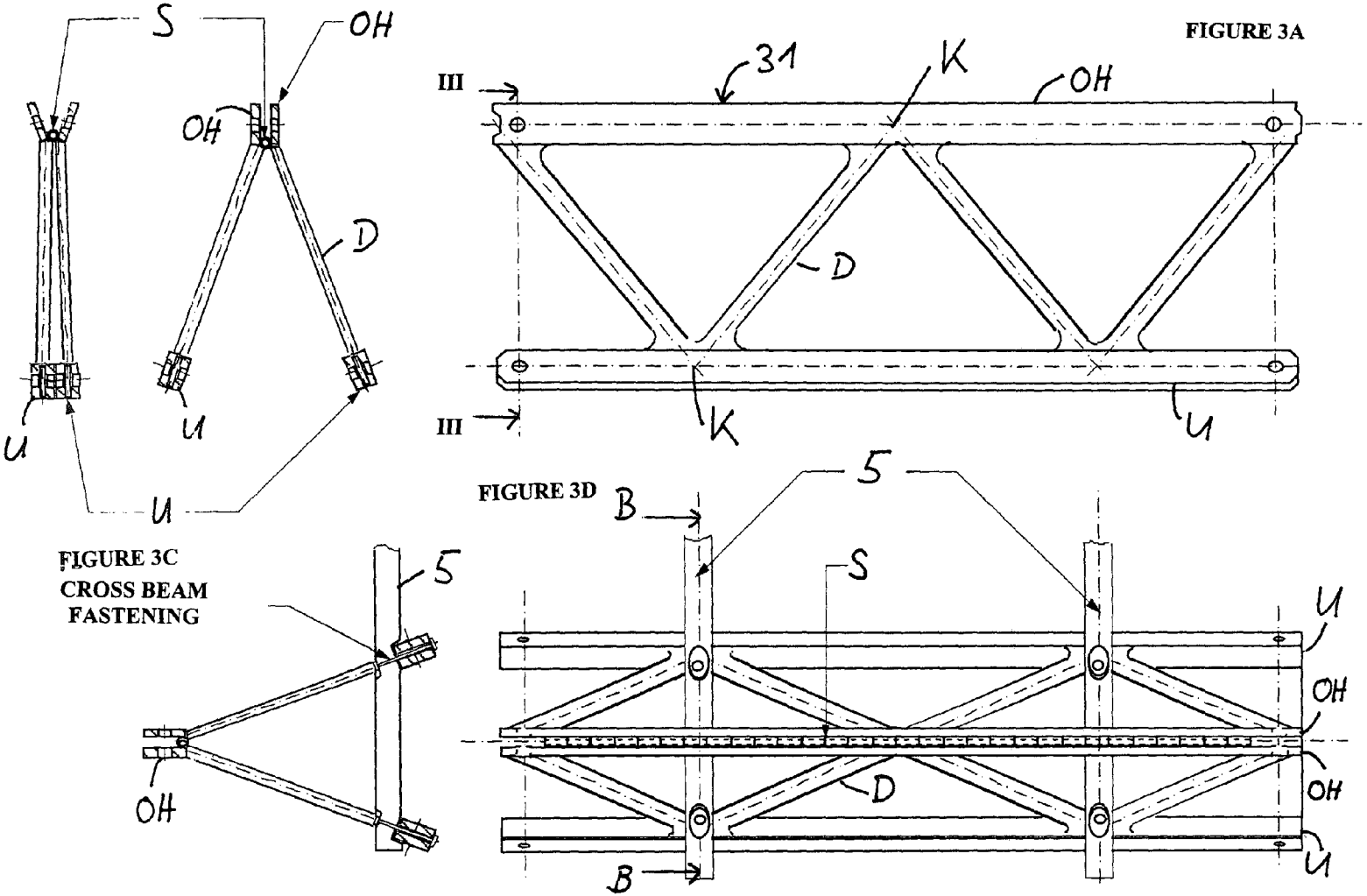
FIG. 3A is a lateral view of a hinged track girder section for the bridges of FIGS. 1, 1A, and 1B, constructed according to an embodiment of the invention.
FIG. 3B is a two part view taken in the direction of line III—III of FIG. 3A, showing the hinged track girder section in the folded condition on the left and the unfolded condition on the right.
FIG. 3C is a view of the hinged track girder section of FIG. 3B, with a schematic depiction of transverse girder attached.
FIG. 3D is a bottom view of the hinged track girder section of FIG. 3A, showing the connected transverse girders.

The two truss planes of a track girder 3 are connected at the upper triangulation point by means of a hinge S (FIG. 3B). In this case, each truss plane brings along half an upper chord OH. Within a truss plane, the components forming it (diagonal struts D, chord profiles O, U) are mutually connected by means of unreleasable connection devices.

As a result of the described possibility of folding-together the track girder, also in the case of a large height, the track girders require only comparatively little storage space. The setting-up of the folded-open form from the folded-together form of the track girder required for the transport can be implemented rapidly and without any supplementary devices.

In the embodiment illustrated in FIGS. 3A–3C, the lower chords U of a track girder 3, in the folded-open condition, are oriented in the direction of the pertaining truss plane; thus, a longitudinal side of the lower chord U (the longer side of the rectangular lower chord) is situated parallel to the truss plane.

Figure 4:
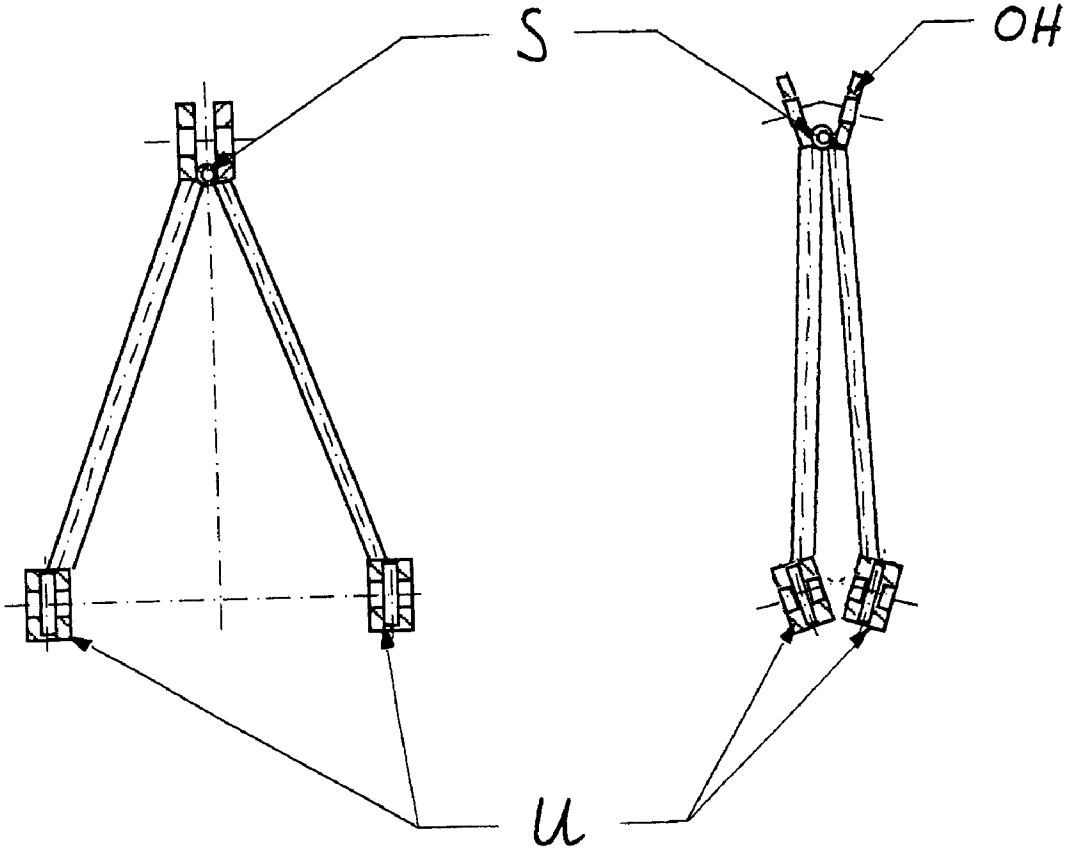
FIG. 4 is a sectional view of another embodiment of a hinged track girder shown in the unfolded condition on the left and as well as in the folded condition on the right.

An alternative thereto is illustrated in FIG. 4. Here, a lower chord U is perpendicularly oriented in the folded-open condition; that is, the longitudinal side of the lower chord (the longer side of the rectangular lower chord) is in a perpendicular position with respect to a local horizontal plane.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Collapsible bridge, having two track girders which are constructed as truss girders with a triangular cross-section, wherein a chord profile is provided at each triangulation point, and wherein two corners of the triangular cross-section are situated at the same level, and the third corner is situated above the latter, wherein, in each case, between one of the lower triangulation points and the upper triangulation point, a truss plane is formed comprising diagonal struts, the lower chord and the upper chord, wherein lower and upper truss nodes respectively are formed at the points of the connection of two diagonal struts and a lower chord and an upper chord respectively, wherein the two track girders are force-lockingly connected by transverse girders, wherein roadway planks are provided which are aligned in the longitudinal direction of the bridge and are force-lockingly connected with the transverse girders, wherein the transverse girders are fitted completely through the track girders and are force-lockingly connected with the latter, so that the transverse girders fix the distance between the two truss planes on the bottom side of a track girder as well as the two track girders with respect to one another, wherein the transverse girders rest on the lower nodes of the two truss planes of a track girder and are force-lockingly connected with the latter, and wherein the two truss planes of a track girder are connected at the upper triangulation point of the track girder cross-section by means of a hinge, so that, when the bridge is taken down, the track girders can be folded together.

2. Collapsible bridge according to claim 1, wherein a longitudinal side of a lower chord situated at the lower triangulation points of a track girder is aligned parallel to the pertaining truss plane.

3. Collapsible bridge according to claim 1, wherein a longitudinal side of a lower chord situated at the lower triangulation points of a track girder has a perpendicular alignment with respect to a local horizontal plane.

4. Collapsible bridge according to claim 1, wherein the transverse girders and/or the roadway planks consist of extruded, tube-shaped fiber composite profiles.

5. Collapsible bridge according to claim 2, wherein the transverse girders and/or the roadway planks consist of extruded, tube-shaped fiber composite profiles.

6. Collapsible bridge according to claim 3, wherein the transverse girders and/or the roadway planks consist of extruded, tube-shaped fiber composite profiles.

7. Collapsible bridge according to claim 1, wherein the transverse girders are bent at right angles at a transition area to the track girders.

8. Collapsible bridge according to claim 2, wherein the transverse girders are bent at right angles at a transition area to the track girders.

9. Collapsible bridge according to claim 3, wherein the transverse girders are bent at right angles at a transition area to the track girders.

10. Collapsible bridge according to claim 4, wherein the transverse girders are bent at right angles at a transition area to the track girders.

11. Collapsible bridge according to claim 1, wherein the track girders are coupled together in the longitudinal direction of the bridge from one or several track girder sections.

12. Collapsible bridge according to claim 2, wherein the track girders are coupled together in the longitudinal direction of the bridge from one or several track girder sections.

13. Collapsible bridge according to claim 3, wherein the track girders are coupled together in the longitudinal direction of the bridge from one or several track girder sections.

14. Collapsible bridge according to claim 4, wherein the track girders are coupled together in the longitudinal direction of the bridge from one or several track girder sections.

15. Collapsible bridge according to claim 7, wherein the track girders are coupled together in the longitudinal direction of the bridge from one or several track girder sections.

16. Collapsible bridge according to claim 1, wherein the track girders are coupled at their ends with end pieces which form bearings of the bridge.

17. Collapsible bridge according to claim 2, wherein the track girders are coupled at their ends with end pieces which form bearings of the bridge.

18. Collapsible bridge according to claim 3, wherein the track girders are coupled at their ends with end pieces which form bearings of the bridge.

19. Collapsible bridge according to claim 4, wherein the track girders are coupled at their ends with end pieces which form bearings of the bridge.

20. Collapsible bridge according to claim 7, wherein the track girders are coupled at their ends with end pieces which form bearings of the bridge.

21. Collapsible bridge according to claim 11, wherein the track girders are coupled at their ends with end pieces which form bearings of the bridge.

* * * * *